United States Patent [19]

Lewis et al.

[11] Patent Number: 4,808,908

[45] Date of Patent: Feb. 28, 1989

[54] CURVATURE CORRECTION OF BIPOLAR BANDGAP REFERENCES

[75] Inventors: Stephen R. Lewis, Reading; A. Paul Brokaw, Burlington, both of Mass.

[73] Assignee: Analog Devices, Inc., Norwood, Mass.

[21] Appl. No.: 156,178

[22] Filed: Feb. 16, 1988

[51] Int. Cl.[4] ..... G05F 3/16

[52] U.S. Cl. ..... 323/313; 323/315; 323/907

[58] Field of Search ..... 323/313, 315, 907

[56] References Cited

U.S. PATENT DOCUMENTS

| | | | |
|---|---|---|---|
| 3,648,153 | 3/1972 | Graf | 323/313 |
| 4,250,445 | 2/1981 | Brokaw | 323/907 |
| 4,433,283 | 2/1984 | Gersbach | 323/315 |
| 4,472,675 | 9/1984 | Shinomiya | 323/907 |
| 4,590,418 | 5/1986 | Moriarty | 323/313 |
| 4,622,512 | 11/1986 | Brokaw | 323/907 |
| 4,634,959 | 1/1987 | Boackmann | 323/313 |
| 4,714,872 | 12/1987 | Traa | 323/315 |

OTHER PUBLICATIONS

Palmer, Dobkin, "Data Acquisition Circuits," 2/81, 1981 IEEE International Solid-State Circuits Conference, *Digest of Technical Papers*, pp. 58-59.

Meijer et al., "A New Curvature-Corrected Bandgap Reference", 12/82, *IEEE Journal of Solid-State Circuits*, vol. SC-17, No. 6, pp. 1139-1143.

Brokaw, "A Simple Three-Terminal IC Bandgap Reference", 1974, *IEEE Journal of Solid-State Circuits*, vol. SC-9, pp. 388-393.

Horowitz, Hill, *The Art of Electronics*, Cambridge University Press, pp. 195-199.

Song, Gray, "A Precision Curvature-Compensated CMOS Bandgap Reference", 1983, IEEE International Solid-State Circuits Conference, *Digest of Technical Papers*, pp. 240-241.

*Primary Examiner*—Patrick R. Salce
*Assistant Examiner*—Jeffrey Sterrett
*Attorney, Agent, or Firm*—Wolf, Greenfield & Sacks

[57] ABSTRACT

A bipolar bandgap reference circuit employing three resistors of selected nominal resistance values and a method of trimming the values of two of the resistors to cancel the slope and curvature of output voltage due to thermal drift. One of the resistors provides a positive temperature coefficient to counter the temperature dependency of bipolar base-emitter characteristics; this resistor is not trimmed. The other two resistors are thin-film, low TC devices and are "trimmed" (i.e., adjusted) sequentially, to match calculated values intended to minimize the first and second derivatives of the bandgap cell output, as a function of temperature.

4 Claims, 4 Drawing Sheets

CURVATURE CORRECTION OF BIPOLAR BANDGAP REFERENCES

FIELD OF THE INVENTION

This invention relates to circuits for generating stable reference voltages and, in particular, to circuits known as "bandgap" voltage references. The invention is directed to the temperature compensation of bandgap references.

BACKGROUND OF THE INVENTION

The need for stable reference voltages is common in the design of electronic equipment. Nearly all electronic circuits require one or more sources of stable DC voltage. A variety of types of reference voltage supplies are known in the art. Reference supplies stabilized by zener diodes are often used in this application, for example. The zener diode, however, is a noisy component; further, it cannot be used with very low-voltage supplies, and it suffers from long-term stability problems. As an alternative, circuits known as "bandgap" references have become popular. Bandgap reference circuits can be operated from low-voltage sources and depend mainly upon sub-surface effects of semiconductor materials, which tend to be more stable than the surface breakdowns generally obtained with zener diodes.

A bandgap voltage reference circuit generally employs two transistors operated at different current densities, and means for developing a voltage proportional to the difference in the base-emitter voltages of those transistors (termed $\Delta V_{BE}$). Usually, the bases of the two transistors are tied together and a resistor connects their emitters, to sense the difference in $V_{BE}$'s.

A bandgap reference might more properly be called a $V_{BE}$ reference, as it basically involves the generation of a voltage with a positive temperature coefficient the same as the negative coefficient of a transistor base-emitter junction voltage (i.e., $V_{BE}$). When the voltage with the positive temperature coefficient is added to a $V_{BE}$, the resultant voltage has a zero temperature coefficient in the ideal case. Substantially all bandgap references feature the summation of a base-emitter junction voltage with a voltage generated from a pair of transistors operated with some ratio of current densities. Conventional bandgap reference circuits are explained in many texts, including P. Horowitz and W. Hill, *The Art of Electronics,* Cambridge University Press, Cambridge, England, 1980, at 195–199, which is hereby bandgap reference circuit is illustrated in FIG. 1.

The base-emitter voltage of a transistor exhibits a temperature-dependent function. Consequently, the output voltage of a bandgap reference circuit will exhibit a similar temperature dependency unless special steps are taken to eliminate that dependency. The thermal non-linearity of a bandgap reference cell generally is termed "curvature." Efforts have been made in the past to compensate for such curvature (as a function of temperature) to reduce long-term thermal drift. As explained in U.S. Pat. No. 4,250,445, titled "Band-Gap Voltage Reference with Curvature Correction" issued Feb. 10, 1981 to A. Paul Brokaw, the mathematical relationships regarding the variation of voltage with the temperature in bandgap devices commonly are simplified for purposes of analysis, by ignoring certain terms of the basic equation since those terms express only secondary effects. Those effects, however, can be important in some applications. Justification exists, therefore, for providing a way to minimize variations in the output voltage of a bandgap reference circuit, with respect to temperature variations.

The equations defining the output voltage dependency on temperature, for a simple three-terminal IC band-gap reference, are listed in the aforesaid U.S. Pat. No. 4,250,445, as taken from A. Paul Brokaw, "A Simple Three-Terminal IC Band-Gap Reference", *IEEE J. Solid-State Circuits,* Vol. SC-9, No. 6, December 1974, pp. 388–393. As stated in U.S. Pat. No. 4,250,445, the output voltage varies with temperature in such a way that an exact compensation for such variation would require quite complex circuitry, too costly for most applications.

In the circuit of U.S. Pat. No. 4,250,445, reproduced herein as FIG. 2, a degree of compensation for the second order temperature-dependency of bandgap reference output voltage is obtained by incorporating into the reference circuit, in series with the usual emitter resistor, a second resistor ($R_b$) having a more positive temperature coefficient (TC) than the first resistor ($R_a$, which has a nearly zero TC). The current developed in the series combination of $R_a$ and $R_b$ is proportional to absolute temperature (PTAT). The positive TC of resistor $R_b$, together with the PTAT current flowing therethrough, produces a voltage which is partially described by a parabolic term. Under ideal conditions, the circuit elements can be so arranged that the additional voltage component resulting from the parabolic term substantially counteracts the second order variation of the voltage produced by the basic bandgap circuit. Ideal conditions do not occur in typical manufacturing environments, though. Resistor $R_b$ will generally be a diffused resistor, to attain a high, positive TC. The resistance of such a resistor is hard to control precisely and substantial variation in resistance value will occur in a manufacturing environment; moreover, such a resistance is not easily adjusted by laser trimming.

Alternatively, Palmer and Dobkin have described a circuit which provides a 12:1 reduction in output drift. The circuit, as reproduced here in FIG. 3, is relatively complicated. The temperature behavior of the collector voltage for transistor Q15 is set to be PTAT, and that of the collector current of transistor Q24 to be proportional to emitter-base voltage. This is said to create a thermal non-linearity in the difference between the base-emitter voltages of transistors Q15 and Q16 that effectively compensates for the curvature observed in the base-emitter voltages of transistors Q20 and Q22. Central to the operation of this circuit is the addition of the diode-connected transistor Q20, whose presence permits biasing of both the reference cell and its error amplifier directly from the regulated output. Apparently, only thin-film resistors are used throughout. C. R Palmer and R. C. Dobkin, "A Curvature Corrected Micropower Voltage Reference", *Proceedings of the* 1981 *IEEE International Solid-State Circuits Conference* at 58–59.

Another curvature-corrected bandgap reference circuit is described in G. C. M. Meijer et al., "A New Curvature-Corrected Bandgap Reference", *IEEE Journal of Solid-State Circuits,* Vol. SC-17, No. 6, December 1982, at 1139–1143. Meijer et al. claim a 20:1 reduction in thermal non-linearity compared to conventional bandgap references. By contrast with Palmer and Dobkin, they claim to compensate directly for the non-linearity of the base-emitter voltage and to use only high-performance NPN transistors instead of lateral PNP's. Meijer et al. compensate for the non-linearity in $V_{BE}$ by making the collector current temperature-dependent. A schematic circuit diagram of the Meijer et al. reference is shown in FIG. 4. The four series-connected base-emitter junctions of transistors Q1–Q4 are biased at a PTAT current $I_{PTAT}$, while the three series-connected base-emitter junctions of transistors Q12–Q14 are biased at a temperature-independent current, $I_{REF}$. For a transistor operated at PTAT current, the thermal non-linearity in $V_{BE}$ about 25 percent less than that of a transistor biased at a constant current. Subtracting the three base-emitter voltages with higher non-linearity from the four with the 25 percent lower non-linearity yields a voltage $V'_{BE}$ which changes linearly with the temperature. The linear portion of the temperature dependence of $V'_{BE}$ is conventionally cancelled by connecting a series resistor $R_1$ in the path of the PTAT current. The non-linearity of $V_{BE}(T)$ is somewhat dependent on the bias current, so that the compensation can be optimized by properly choosing that current.

B. S. Song and P. R. Gray have described yet another type of temperature-compensated bandgap reference which has been particularly adapted for use with CMOS technology. Their circuit employs a switched capacitor technique and does not provide continuous output, making it generally unsuitable for many cases where the present invention may be used (i.e., continuous analog environments). B. S. Song, P. R. Gray, "A Precision Curvature-Compensated CMOS Bandgap Reference," *Proceedings of the* 1983 *IEEE International Solid-State Circuits Conference,* Feb. 25, 1983, at 240–241.

From the foregoing references, it will be apparent that many prior art attempts to improve the stability and reduce the thermal non-linearity (i.e., curvature) of bandgap references have necessitated substantial increases in circuit complexity. This, of course, increases the percentage of an integrated circuit which must be devoted to reference circuits and decreases the amount of chip area available for other circuits.

Accordingly, it is an object of the present invention to provide a bandgap reference with improved compensation for its inherent temperature characteristic, with such compensation to be effective in an integrated circuit manufacturing environment.

Another object of the invention is to improve the bandgap reference of U.S. Pat. No. 4,250,445, to improve its performance under the conditions present in integrated circuit manufacturing processes.

SUMMARY OF THE INVENTION

The foregoing and other objects of the present invention are achieved using a modification of the circuit of U.S. Pat. No. 4,250,445, the disclosure of which is hereby incorporated by reference. Using the notation of that patent, the resistors 16 and 18 (having resistances $R_2$ and $R_a$, respectively) are thin-film resistors of low (i.e., near zero) TC, while resistor 22 (having resistance $R_b$) is a resistor having a substantial positive TC. A test point 28 is added at the junction between resistors 18 and 22; the voltage at that test point is designated $V_{comp}$. While measuring $V_{comp}$, the two thin-film resistors 16 and 18 are "trimmed" (i.e., adjusted) sequentially to minimize the first and second derivatives of the bandgap cell output as a function of temperature. Laser trimming of thin-film resistors is commonly employed in today's integrated circuit manufacturing processes, so this approach is well-suited to mass production usage.

More specifically, the technique is as follows: First, the approximate values for the three resistors 16, 18 and 22 are calculated from known formulae. Next, the voltage $V_{comp}$ is measured and resistance $R_2$ is adjusted to cause $V_{comp}$ to have a defined voltage established by a relationship set forth below in the detailed description. Then the output voltage of the circuit, $V_{BG}$, is measured and resistance $R_a$ is trimmed to adjust $V_{BG}$ to a value established by another relationship set forth below in the detailed description.

The invention will be more fully understood from the detailed description set forth below, which should be read in conjunction with the accompanying drawing.

DETAILED DESCRIPTION

Figure 1:
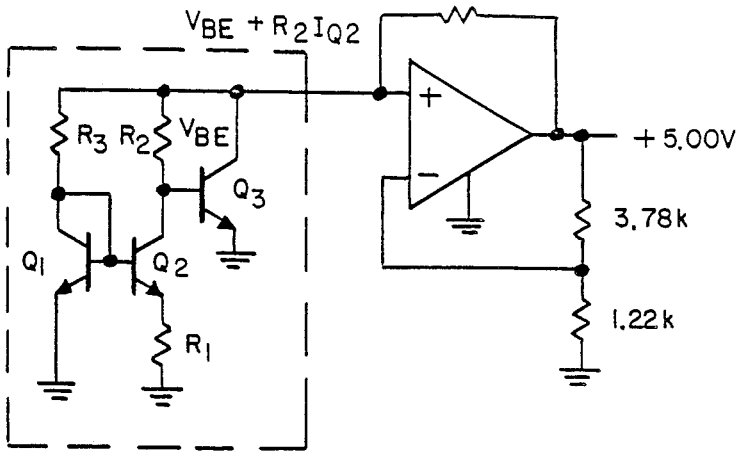
FIG. 1 PRIOR ART
FIG. 1 is a schematic diagram of a basic bipolar bandgap reference circuit according to the prior art.
Figure 2:
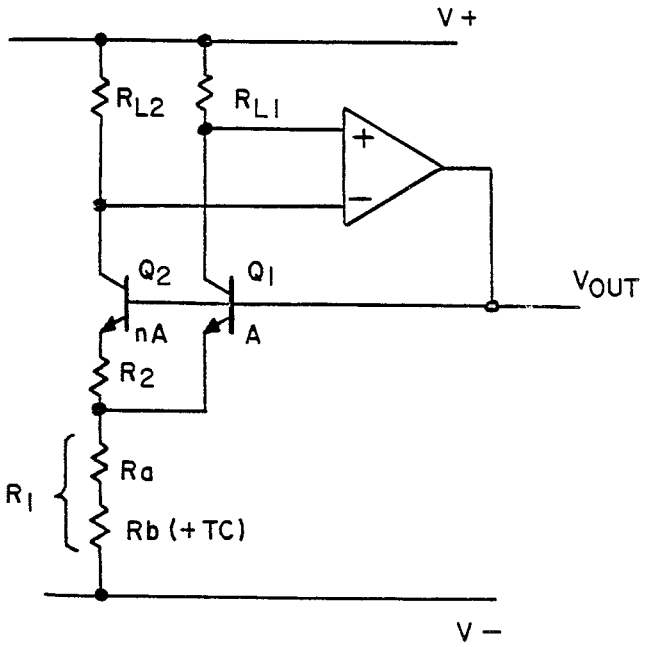
FIG. 2 PRIOR ART
FIG. 2 is a schematic diagram of a prior art bandgap reference circuit in accordance with U.S. Pat. No. 4,250,445.
Figure 3:
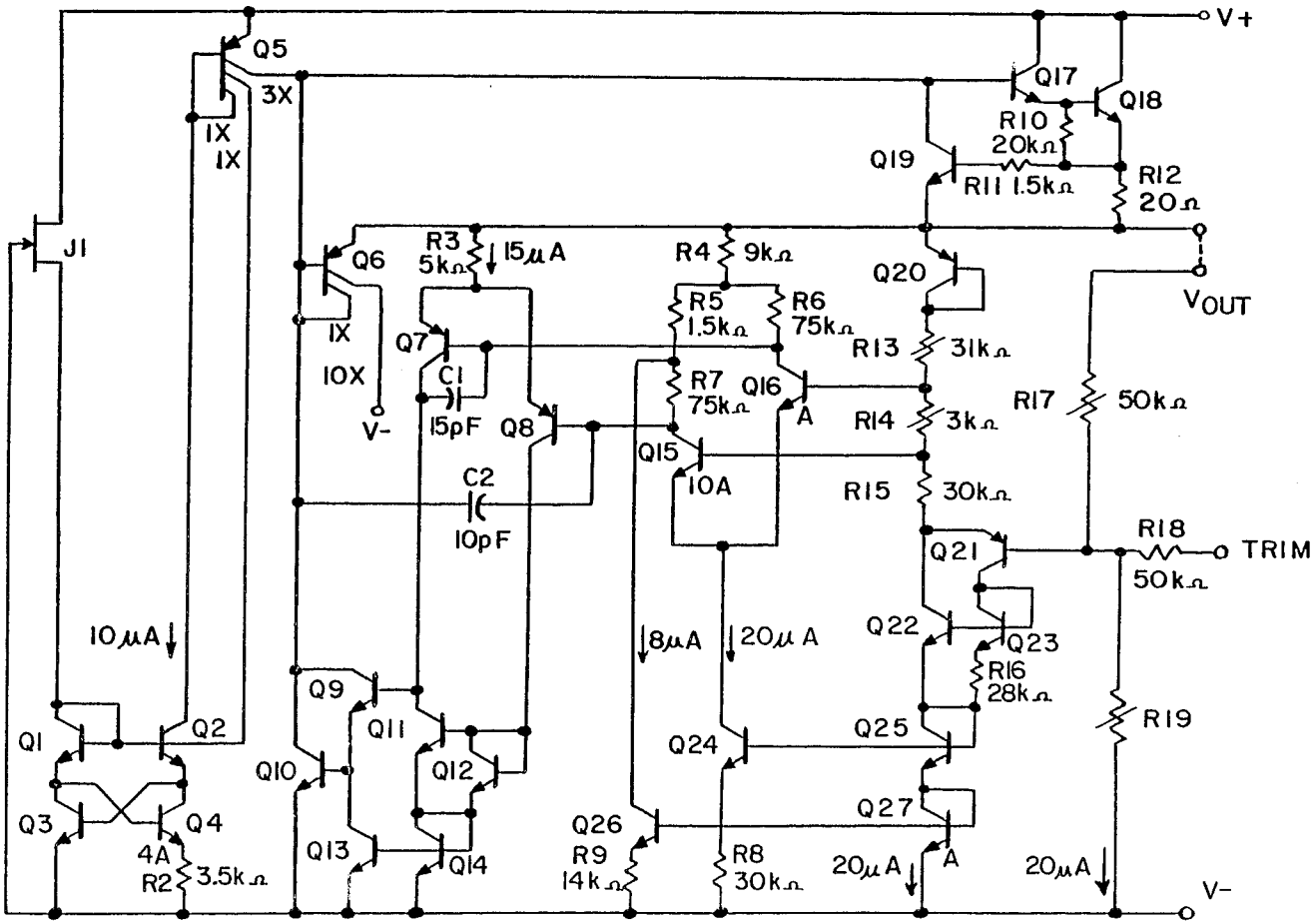
FIG. 3 PRIOR ART
FIG. 3 is a schematic diagram of a prior art bandgap reference circuit in accordance with the teachings of C. R. Palmer and R. C. Dobkin.
Figure 4:
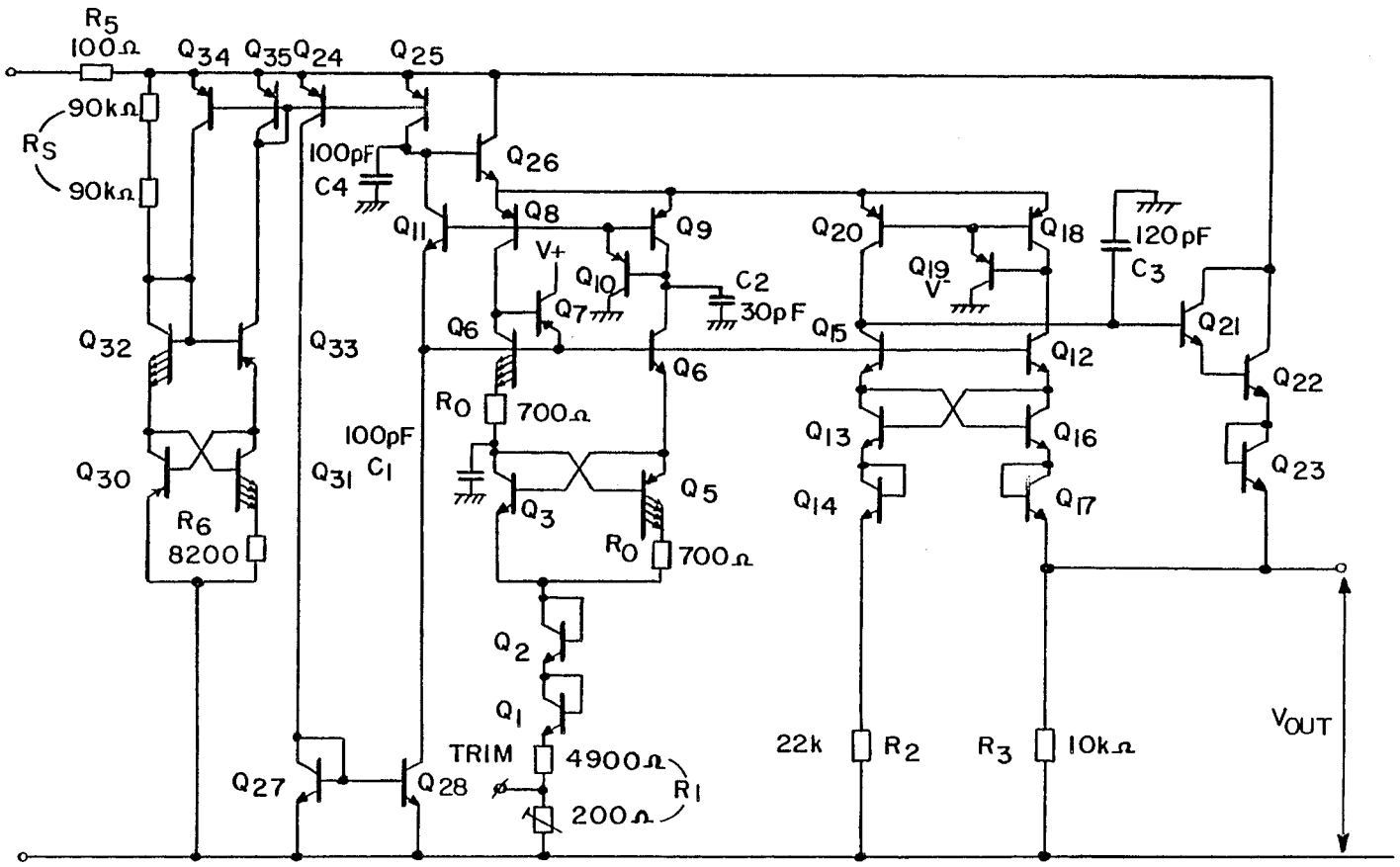
FIG. 4 PRIOR ART
FIG. 4 is a schematic diagram of a prior art bandgap reference circuit in accordance with the teachings of G. C. M. Meijer et al.
Figure 5:
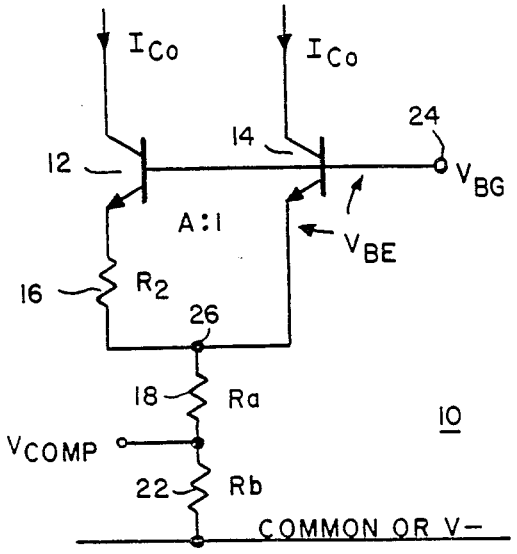
FIG. 5 is a schematic diagram of a bandgap reference circuit in accordance with the present invention.
Figure 6:
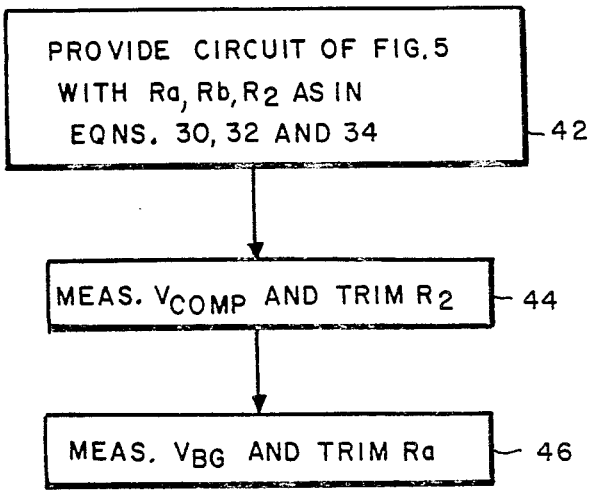
FIG. 6 is a flow diagram illustrating the method of the present invention.

Referring to FIG. 5, a bandgap voltage reference circuit, or cell, 10 according to the present invention, is shown. This circuit is provided as a starting point, with resistors 16 and 18 to be trimmed to minimize thermal drift (Step 42 of the method of FIG. 6). The reference circuit comprises first and second transistors 12 and 14, together with three resistors 16, 18 and 22. The resistance values of the three resistors 16, 18 and 22 are, respectively, $R_2$, $R_a$ and $R_b$. The areas of the emitters of transistors 12 and 14 are formed in a ratio A:1. The bases of transistors 12 and 14 are connected together and to an output lead, or terminal, 24, at which the output voltage $V_{BG}$, is provided. The emitter of transistor 12 is connected to one end of resistor 16. The other end of resistor 16 is connected to the emitter of transistor 14 and at node 26 to one end of a voltage divider formed by resistors 18 and 22. The junction of resistors 18 and 22 provides a voltage divider tap which is supplied to a terminal or test point 28, at which the voltage $V_{comp}$ may be measured. The base-emitter junction of transistor 14 is the junction whose temperature-dependent characteristics cause thermal drift and necessitate compensation.

Resistor 22, as taught in U.S. Pat. No. 4,250,445, has a substantial positive temperature coefficient; a diffused resistor, for example, is well-suited to providing this characteristic. Advantageously, the invention makes possible the use of a temperature coefficient for this resistor which is typically about 1500–2000 PPM, a value common to diffused resistors in standard silicon semiconductor processing. The resistance value $R_b$ of resistor 22 as a function of temperature, is given by the expression $R_b=R_{bo}(1+CT)$, where $R_{bo}$ is the nominal resistance of the resistor at zero degrees Kelvin, C is the temperature coefficient of the resistor and T is the temperature in degrees Kelvin.

The approximate resistance values for resistors 16, 18 and 22 are found from the following three formulas:

$$R_2 = \frac{V_{To}\ln(A)}{I_{Co}} \quad \text{Eqn. 30}$$

$$R_{bo} = \frac{R_2(M-1)}{4CT_o\ln(A)} \quad \text{Eqn. 32}$$

$$R_a = \frac{R_2[V_{go} - V_{BEo} + (M-1)V_{To}]}{2V_{To}\ln(A)} - R_{bo}(1+2CT_o) \quad \text{Eqn. 34}$$

where the variables have the following meaning: M is the "curvature factor" of $V_{BE}$ for the semiconductor process used to make transistors 12 and 14; $V_{go}$ is the bandgap voltage using that semiconductor process; C is the first order temperature coefficient of the resistor material used for resistor 22; $V_{BEo}$ is the value of a single unit area $V_{BE}$ at temperature $T_o$; $V_{To}=kTo/q$; and $I_{Co}$ is the value of each collector current at temperature T=To. The curvature factor M is obtained in a conventional fashion.

Next (Step 44), after the resistors have been set to their approximate values as calculated, voltage $V_{comp}$ is measured at point 28 and the value $R_2$ of resistor 16 is "trimmed" to adjust $V_{comp}$ to the value $$V_{compT=To} = \frac{V_{To}(M-1)(1+CT_o)}{2CT_o} \quad (36)$$

Finally (Step 46), the voltage $V_{BG}$ is measured at point 24 and the value $R_a$ of resistor 18 is trimmed to adjust $V_{BG}$ to the value established by the relationship $$V_{BG}=V_{go}+V_{To}(M-1)/2 \quad (38)$$

The trimming of resistor 18 essentially cancels out first order temperature dependencies (i.e., "slope" of $V_{BG}$ as a function of temperature) and the trimming of resistor 16 minimizes the second derivative of $V_{BG}$ as a function of temperature (i.e., "curvature").

The expression for resistance $R_{bo}$ is obtained by first solving for the first and second partial derivatives of the equation for $V_{BG}$, as a function of temperature, and then setting those derivatives to zero. The latter step takes advantage of the fact that two trim points are available. The resulting equations can be solved for $R_{bo}$ and $R_a$, to yield equations 32 and 34.

Resistors 16 and 18 may be (low TC) thin-film resistors which can easily be trimming using conventional laser trimming techniques, while resistor 22 generally will be a diffused resistor (to obtain the desired positive temperature coefficient), and such resistors are not subject to laser trimming. Further, the production variations in resistor 22 from the nominal, desired value, can be substantial. Thus, the technique of the present invention is particularly useful in the kind of manufacturing environment typically encountered in the production of IC bandgap references.

The assumption has been made above that the current density difference between the two transistors has been produced by using transistors having different emitter areas and the same collector current. Other techniques may also be used. For example, the two transistors may have the same emitter areas but be operated at different collector currents. In that event, the collector current of transistor 12 may be labelled $I_{C1o}$ and that of transistor 14, $I_{C2o}$. Equations 30, 32 and 34 are then replaced by the following corresponding equations 30', 32' and 34', respectively, wherein the variable A now designates a current ratio instead of an area ratio (i.e., $A=I_{C2o}/I_{C1o}$):

$$R_2 = \frac{V_{To}\ln(A)}{I_{C1o}} \quad \text{Eqn. 30'}$$

$$R_{bo} = \frac{R_2(M-1)}{2(1+A)CT_o\ln(A)} \quad \text{Eqn. 32'}$$

$$R_a = \frac{R_2[V_{go} - V_{BEo} + (M-1)V_{To}]}{(1+A)V_{To}\ln(A)} - R_{bo}(1+2CT_o) \quad \text{Eqn. 34'}$$

Similar equations can be derived to use when both the areas and the currents are different.

Having thus described an exemplary method and circuit produced thereby, it is to be expected that various alterations, modifications and improvements will now occur to those skilled in the art. Accordingly, the foregoing description is intended to be illustrative only, and not limiting. The invention is limited only by the claims which follow and equivalents thereto.

What is claimed is:

1. In a solid-state regulated voltage supply of the type including first and second transistors operated at different current densities and connected with associated circuitry to develop a current with a positive temperature coefficient (TC) proportional to the difference in the respective base-to-emitter-voltages of said transistors, said current passing through at least first and second resistors to develop in the first resistor a first corresponding voltage and in the second resistor a second corresponding voltage, the second resistor having a TC that is substantially more positive than the TC of the first resistor, and the second corresponding voltage having a corresponding positive TC substantially exceeding the TC of the first corresponding voltage, the voltage supply including means combining said first and second corresponding voltages with a negative TC voltage derived from the base-to-emitter-voltage of one of the first and second transistors, to provide a composite temperature compensated output voltage, the improvement comprising:

the resistance values of the first and second resistors being such as to cause the voltage $V_{comp}$ at the junction of the first and second resistors, at the ambient temperature $T_o$ to be described by the formula $$V_{compT=To} = \frac{V_{To}(M-1)(1+CT_o)}{2CT_o}$$

where M is the "curvature factor" of $V_{BE}$ for the semiconductor process used to make the transistors; C is the first order temperature coefficient of the material used for the second resistor, referenced from zero degrees Kelvin; and $V_{To}$32 kTo/q, where k is the Boltzmann constant and q is the electronic charge.

2. The bandgap reference circuit of claim 1 wherein the resistance values of the first and second resistors are additionally set so that the output voltage $V_{BG}$ satisfies the relationship $$V_{BG}=V_{go}+V_{To}(M-1)/2.$$

3. In the manufacture of a solid state regulated voltage supply of the type including first and second transistors, first and second resistors connected in series between the emitter of the first transistor and a reference line such that the second resistor is the one connected to the reference line, and a third resistor connected between the emitters of the first and second transistors, means for providing a predetermined nonunity ratio of current densities for the currents passing through the emitters of the first and second transistors, and wherein the second resistor is formed with a temperature coefficient which is substantially more positive than the temperature coefficients of the first and third transistors, the method of compensating for first and second order thermal effects of the difference in base emitter voltages of the first and second transistors comprising the steps of:

a. providing the first, second and third resistors with approximate values given by the formulas $$R_2=\frac{V_{To}\ln(A)}{I_{Co}}$$

$$R_{bo}=\frac{R_2(M-1)}{4CT_o\ln(A)}$$

$$R_a=\frac{R_2[V_{go}-V_{BEo}+(M-1)V_{To}]}{2V_{To}\ln(A)}-R_{bo}(1+2CT_o)$$

where the variables have the following meaning: $R_a$ is the resistance of the first resistor; $R_{bo}$ is the resistance of the second resistor at zero degrees Kelvin; $R_2$ is the resistance of the third resistor; A is the ratio of emitter areas of the first and second transistors; M is the "curvature factor" of $V_{BE}$ for the semiconductor process used to make the transistors; $V_{go}$ is the bandgap voltage using that semiconductor process; C is the first order temperature coefficient of the resistor material used for the second resistor; $V_{To}=kTo/q$, where k is the Boltzmann constant and q is the electronic charge; and $I_{Co}$ is the value of each collector current at temperature T=To;

b. measuring the voltage $V_{comp}$ at the junction of the first and second resistors and trimming the value of the third resistor, $R_2$, to adjust the value of $V_{comp}$ to satisfy the relationship $$V_{compT=T_o}=\frac{V_{To}(M-1)(1+CT_o)}{2CT_o}$$

c. measuring the output voltage of the source, $V_{BG}$ and trimming the resistance value of the first resistor, $R_a$, to adjust $V_{BG}$ to satisfy the relationship $$V_{BG}=V_{go}+V_{To}(M-1)/2.$$

4. In the manufacture of a solid-state regulated voltage supply of the type including first and second transistors, first and second resistors connected in series between the emitter of the first transistor and a reference line such that the second resistor is the one connected to the reference line, and a third resistor connected between the emitters of the first and second transistors, means for providing a predetermined nonunity ratio of current densities for the currents passing through the emitters of the first and second transistors such that the first transistor operates with a collector current $I_{C1}$ and the second transistor operates with a collector current $I_{C2}$, and wherein the second resistor is formed with a temperature coefficient which is substantially more positive than the temperature coefficients of the first and third transistors, the method of compensating for first and second order thermal effects of the difference in base-emitter voltages of the first and second transistors comprising the steps of:

a. providing the first, second and third resistors with approximate values given by the formulas $$R_2=\frac{V_{To}\ln(A)}{I_{C1o}}$$

$$R_{bo}=\frac{R_2(M-1)}{2(1+A)CT_o\ln(A)}$$

$$R_a=\frac{R_2[V_{go}-V_{BEo}+(M-1)V_{To}]}{(1+A)V_{To}\ln(A)}-R_{bo}(1+2CT_o)$$

where the variables have the following meaning: $R_a$ is the resistance of the first resistor; $R_{bo}$ is the resistance of the second resistor at zero degrees Kelvin; $R_2$ is the resistance of the third resistor; A is the ratio of collector currents of the first and second transistors; M is the "curvature factor" of $V_{BE}$ for the semiconductor process used to make the transistors; $V_{go}$ is the bandgap voltage using that semiconductor process; C is the first order temperature coefficient of the resistor material used for the second resistor; $V_{To}=kTo/q$, where k is the Boltzmann constant and q is the electronic charge; and $I_{Co}$ is the value of each collector current at temperature T=To;

b. measuring the voltage $V_{comp}$ at the junction of the first and second resistors and trimming the value of the third resistor, $R_2$, to adjust the value of $V_{comp}$ to satisfy the relationship $$V_{compT=T_o}=\frac{V_{To}(M-1)(1+CT_o)}{2CT_o}$$

c. measuring the output voltage of the source, $V_{BG}$ and trimming the resistance value of the first resistor, $R_a$, to adjust $V_{BG}$ to satisfy the relationship $$V_{BG}=V_{go}+V_{To}(M-1)/2.$$

* * * * *